US008097976B2

(12) United States Patent
Kitagawa et al.

(10) Patent No.: US 8,097,976 B2
(45) Date of Patent: Jan. 17, 2012

(54) LIGHTING CONTROLLER FOR A VEHICLE LAMP

(75) Inventors: Takayoshi Kitagawa, Shizuoka (JP); Yasushi Noyori, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 363 days.

(21) Appl. No.: 12/364,559

(22) Filed: Feb. 3, 2009

(65) Prior Publication Data

US 2009/0200963 A1 Aug. 13, 2009

(30) Foreign Application Priority Data

Feb. 8, 2008 (JP) ..... 2008-028451

(51) Int. Cl.
*B06L 1/14* (2006.01)

(52) U.S. Cl. ..... 307/10.8; 315/219; 315/224; 315/308

(58) Field of Classification Search ..... 315/77–83, 315/291, 299, 307, 308, 312, 320, 324
See application file for complete search history.

(56) References Cited

U.S. PATENT DOCUMENTS

| | | | | |
|---|---|---|---|---|
| 6,281,636 | B1 * | 8/2001 | Okutsu et al. | 315/209 R |
| 6,680,583 | B2 * | 1/2004 | Noda et al. | 315/224 |
| 6,759,812 | B2 * | 7/2004 | Ito et al. | 315/291 |
| 6,844,681 | B2 * | 1/2005 | Serizawa et al. | 315/77 |
| 7,244,036 | B2 * | 7/2007 | Murakami et al. | 362/20 |
| 7,528,553 | B2 * | 5/2009 | Ito et al. | 315/291 |
| 7,635,952 | B2 * | 12/2009 | Takeda et al. | 315/80 |
| 7,750,579 | B2 * | 7/2010 | Aiello | 315/247 |
| 2006/0082332 | A1 * | 4/2006 | Ito et al. | 315/291 |
| 2006/0231745 | A1 | 10/2006 | Bodano et al. | |

FOREIGN PATENT DOCUMENTS

JP 2006-103477 4/2006

* cited by examiner

*Primary Examiner* — Shawki S Ismail
*Assistant Examiner* — Crystal L Hammond
(74) *Attorney, Agent, or Firm* — Fish & Richardson P.C.

(57) ABSTRACT

A lighting controller has current driving means which include a shunt resistor connected in series to each of multiple LEDs to detect an LED driving current, a PMOS transistor connected to the positive electrode side of each of the LEDs, and an amplifier for sending an output according to the result of comparison between the respectively detected driving current values and a reference value, and which subject each of the PMOS transistors to ON/OFF operation. Control means includes a Zener diode ZD1 and a Zener diode ZD2 for detecting an abnormality occurring in the current driving means and for sending the abnormality detection result. The control means controls the PMOS transistor to be turned OFF after elapse of a predetermined time upon receipt of the abnormality detection result.

5 Claims, 3 Drawing Sheets

(FIG. 1 Continued)
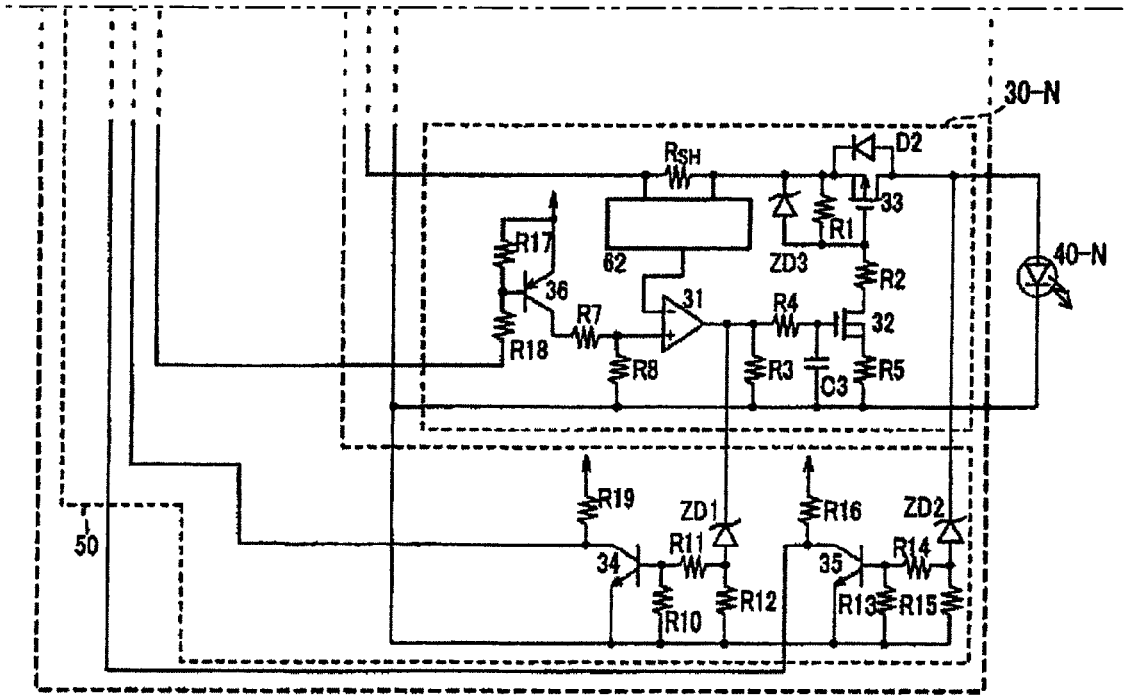

LIGHTING CONTROLLER FOR A VEHICLE LAMP

This application claims the benefit of priority of Japanese application no. 2008-028451, filed on Feb. 8, 2008, the disclosure of which is incorporated herein.

TECHNICAL FIELD

The present disclosure relates to a lighting controller for a vehicle lamp, and in particular, to a lighting controller for a vehicle lamp for controlling the lighting of semiconductor light sources made up of semiconductor light-emitting elements.

BACKGROUND

There are known vehicle lamps in which semiconductor light-emitting elements such as LEDs (Light Emitting Diodes) are used as semiconductor light sources. A lighting controller for controlling the lighting of the LEDs is mounted on vehicle lamps of this kind.

The foregoing lighting controller includes a single switching regulator, series regulators corresponding to a multiple LEDs, and protection control circuits corresponding to the individual series regulators. (See, e.g., Japanese Published Unexamined Patent Application No. 2006-103477.)

The single switching regulator has a capacitor, a transformer, a diode, a first NMOS (Negative Channel Metal Oxide Semiconductor) transistor and a control circuit, acting as current supply means for supplying a driving current to LEDs.

Each of the series regulators includes a comparison amplifier, a second NMOS transistor, a shunt resistor and a reference power source for generating a reference voltage. Each of the second NMOS transistors is connected in series to an LED together with the shunt resistor acting as a switching element. The comparison amplifier compares a reference voltage entered into a non-inverting input terminal (positive input terminal) with a voltage drop (decreased voltage of shunt resistor) input into an inverting input terminal (negative input terminal), generating a gate voltage (control signal) depending on the comparison result, applying the gate voltage to a gate of the second NMOS transistor to control the second NMOS transistor so as to be subjected to ON/OFF operation, thereby gaining control so that a specified current will flow through each of the LEDs.

If a current flowing through any one of the LEDs is lower than the specified current, the gate voltage of the second NMOS transistor increases. If the gate voltage of any one of the second NMOS transistors increases, the control circuit controls the ON/OFF operation to the first NMOS transistor so as to increase the output voltage of the single switching regulator. Further, when the gate voltage of all the second NMOS transistors decrease to a level of threshold voltage, the control circuit controls the switching operation of the first NMOS transistor so as to decrease the output of the single switching regulator.

Each of the protection control circuits controls the operation of a respective one of each second NMOS transistor so as to be safe in response to an abnormal gate voltage due to the applied voltage of each LED or the output of each comparison amplifier. Each of the protection control circuits includes a first Zener diode, a second Zener diode, a diode, a CR circuit, a PNP transistor and an NPN transistor. The cathode side of the first Zener diode is connected to the output side of the comparison amplifier, the cathode side of the second Zener diode is connected to a drain of the second NMOS transistor, and the anode side of the diode is connected to a gate of each of the second NMOS transistors.

The first Zener diode detects the presence or absence of an abnormal gate voltage due to the output of the comparison amplifier. Upon detection of the abnormal gate voltage by the first Zener diode, the operation of each of the second NMOS transistors is controlled.

For example, when an LED is broken as a result of wiring to cause an abnormal opening of the LED, no current will flow through the second NMOS transistor. However, the comparison amplifier provides control so that a specified current will flow through the second NMOS transistor, by which gate voltage of the second NMOS transistor gradually increases due to the output of the comparison amplifier and the second NMOS transistor is saturated in the ON state of operation. Further, when, due to the output of the comparison amplifier, the gate voltage is higher than a Zener voltage of the first Zener diode, a Zener current will flow through the first Zener diode, and an electric charge is accumulated in the capacitor until the elapse of time determined by a time constant of the CR circuit.

When the voltage of both ends of the capacitor is higher than the threshold voltage of the NPN transistor after the elapse of time determined by the time constant, the NPN transistor is in an ON state. Then, with a decrease in potential of a collector of the NPN transistor, the PNP transistor is in the ON state, and current will also flow through the diode. The gate voltage of the second NMOS transistor decreases, and the second NMOS transistor connected to an LED at which an abnormality takes place is in the OFF state.

On the other hand, the second Zener diode monitors the presence or absence of a voltage applied to the second NMOS transistor, that is, an abnormal drain voltage, detecting the abnormality with an increase in drain voltage. For example, when a short circuit occurs between the anode and cathode of an LED, the voltage on both ends of the LED is 0V. Therefore, a drain-source voltage of the second NMOS transistor connected to the LED at which an abnormality take place rises to a greater extent than normal, and the drain-source voltage is higher than a Zener voltage of the second Zener diode. In this instance, Zener current will flow through the second Zener diode, and an electric charge is accumulated in the capacitor until the elapse of time determined by the time constant in the CR circuit.

When the voltage of both ends of the capacitor is higher than the threshold voltage of the NPN transistor after the elapse of time determined by the time constant, the NPN transistor is in the ON state, and the PNP transistor is in the ON state. At the same time, current flows through the diode, the gate voltage of the second NMOS transistor decreases, and the second NMOS transistor is in the OFF state.

Specifically, when an LED is broken as a result of wiring, for the protection of LEDs and circuit elements of series regulators, each of the second NMOS transistors is controlled by each of the protection control circuits so as to be turned OFF. Further, when a short circuit takes place between the anode and cathode of an LED, for the protection of LEDs and circuit elements of series regulators, each of the second NMOS transistors is controlled by a respective one of the protection control circuits so as to be turned OFF.

Where an abnormality takes place as the result of a short circuit between the anode and cathode of an LED, while the abnormality is generated, power is consumed uselessly because the second NMOS transistor continues to consume power. Therefore, in order to sustain the useless consumption of power, it is preferable to halt operation of the series regulator instantly.

On the other hand, where an abnormality takes place by the opening of an LED, the abnormality is to the result of a poor contact of an output wiring or the like. Since an abnormality of this type does not damage a circuit element or lead to smoking and the like, it is preferable to provide such control that time until determination of the abnormality (time determined by the time constant of the CR circuit) is lengthened to make the abnormal detection less sensitive.

However, in the foregoing known technology, where an abnormality is detected as the result of the opening of an LED, after the elapse of time determined by the time constant of the CR circuit, the second NMOS transistor is turned OFF to halt operation of the series regulator. Where an abnormality is detected as the result of a short circuit between the anode and cathode of an LED, after the elapse of time determined by the time constant of the CR circuit, the second NMOS transistor is turned OFF to halt operation of the series regulator. Therefore, the duration from judgment of the abnormality to the halted operation of the series regulator is determined by the time constant of the CR circuit regardless of the type of abnormality.

As a result, in the foregoing known technology, it is difficult to determine an abnormality in an appropriate time depending on the type of abnormality of the LED. Operation of series regulators cannot be halted immediately after the elapse of an appropriate time depending on the type of abnormality, when the abnormality is generated. Thus, there is posed a problem that a circuit element may fail depending on the time until the halted operation of a series regulator.

SUMMARY

The present invention can help prevent the failure of a circuit element by a simple design and can improve safety.

According to one aspect, a lighting controller for a vehicle lamp according to a first embodiment of the present invention includes a switching regulator for supplying a driving current to a first to an N-th (N is an integer number equal to or greater than one) semiconductor light source, a first to an N-th current driving means which include a first to an N-th current detection portion respectively connected in series to each of the semiconductor light sources to detect the driving current, a first to an N-th switch portion respectively connected to the positive electrode side of each of the semiconductor light sources and a first to an N-th comparison portion for comparing a value of the driving current detected by each of the current detection portions with a predetermined threshold value to send a comparison output according to the thus obtained comparison results and which subject each of the switch portions to ON/OFF operation according to the respective comparison outputs and control means having two or more abnormality detection portions for detecting an abnormality generated in the current driving means to send the abnormality detection result, in which the control means controls each of the switch portions so as to be turned OFF after the elapse of a predetermined time upon receipt of the abnormality detection result and the predetermined time varies depending on abnormality detection results sent by the two or more abnormality detection portions.

In some implementations, the control means has a first to an N-th first abnormality detection portion which detect an output side voltage of the comparison portion, compare the detected output side voltage with a predetermined reference value to detect an abnormality and send respectively a first to an N-th first abnormality detection result. The control means also has a first to an N-th second abnormality detection portion which detect a positive electrode side voltage of the semiconductor light source, compare the detected positive electrode side voltage with a predetermined reference value to detect an abnormality and send respectively a first to an N-th second abnormality detection result. After the elapse of the first time respectively upon receipt of the first to the N-th first abnormality detection result or after the elapse of the second time respectively upon receipt of the first to the N-th second abnormality detection result, a comparison output at the first to the N-th comparison portion is controlled so that each of the switch portions is turned OFF.

In some implementations, the control means has a current driving control portion including a storage portion which stores in advance the first time and the second time. After the elapse of the first and second times read, respectively, from the storage portion upon receipt of the first abnormality detection result and the second abnormality detection result, the current driving control portion sends a control signal to the comparison portion so that each of the switch portions is turned OFF.

In some implementations, where at least one abnormality detection portion of the first abnormality detection portions and the second abnormality detection portions detects an abnormality, the abnormality detection result is sent by a single first signal wire. Where at least one abnormality detection portion of the first to the N-th second abnormality detection portion detects an abnormality, the second abnormality detection result is sent by a single second signal wire.

According to the first aspect, it is possible to determine an abnormality in an appropriate time depending on the type of abnormality of the LED and also halt the operation of a series regulator immediately after the elapse of an appropriate time. It is also possible to prevent the failure of a circuit element by a simple design and improve safety.

According to another aspect, the control means includes a first to an N-th first abnormality detection portion which detect an output side voltage of the comparison portion, compare the detected output side voltage with a predetermined reference value to detect an abnormality and respectively send a first to an N-th first abnormality detection result. The control means also has a first to an N-th second abnormality detection portion which detect a positive electrode side voltage of the semiconductor light source, compare the thus detected positive electrode side voltage with a predetermined reference value to detect an abnormality and respectively send a first to an N-th second abnormality detection result. After elapse of the first time respectively upon receipt of the first to the N-th first abnormality detection result or after elapse of the second time respectively upon receipt of the first to the N-th second abnormality detection result, the comparison output at the first to the N-th comparison portion is controlled so that each of the switch portions is turned OFF. Therefore, it is possible to set an appropriate time depending on the type of abnormality of an LED by a simple design.

According to a further aspect, the control means has a current driving control portion including a storage portion which stores in advance the first time and the second time. After elapse of the first and second times read from the storage portion respectively upon receipt of the first abnormality detection result and the second abnormality detection result, the current driving control portion sends a control signal to the comparison portion so that each of the switch portions is turned OFF. Therefore, it is possible to set an appropriate time depending on the type of abnormality of an LED by a simple design.

According to another aspect, where at least one abnormality detection portion of the first abnormality detection portions and the second abnormality detection portions detects an abnormality, the abnormality detection result is sent by a single first signal wire. Where at least one abnormality detection portion of the first to the N-th second abnormality detection portion detects an abnormality, the second abnormality detection result is sent by a single second signal wire. Therefore, an abnormality can be determined in an appropriate time, depending on the type of abnormality of an LED, by using a circuit arranged so as to reduce the number of abnormality-detecting terminals to the minimum necessary. As a result, it is possible to reduce the number of input terminals used in a microcomputer as control means.

DETAILED DESCRIPTION OF BEST MODE FOR CARRYING OUT THE INVENTION

Figure 1:
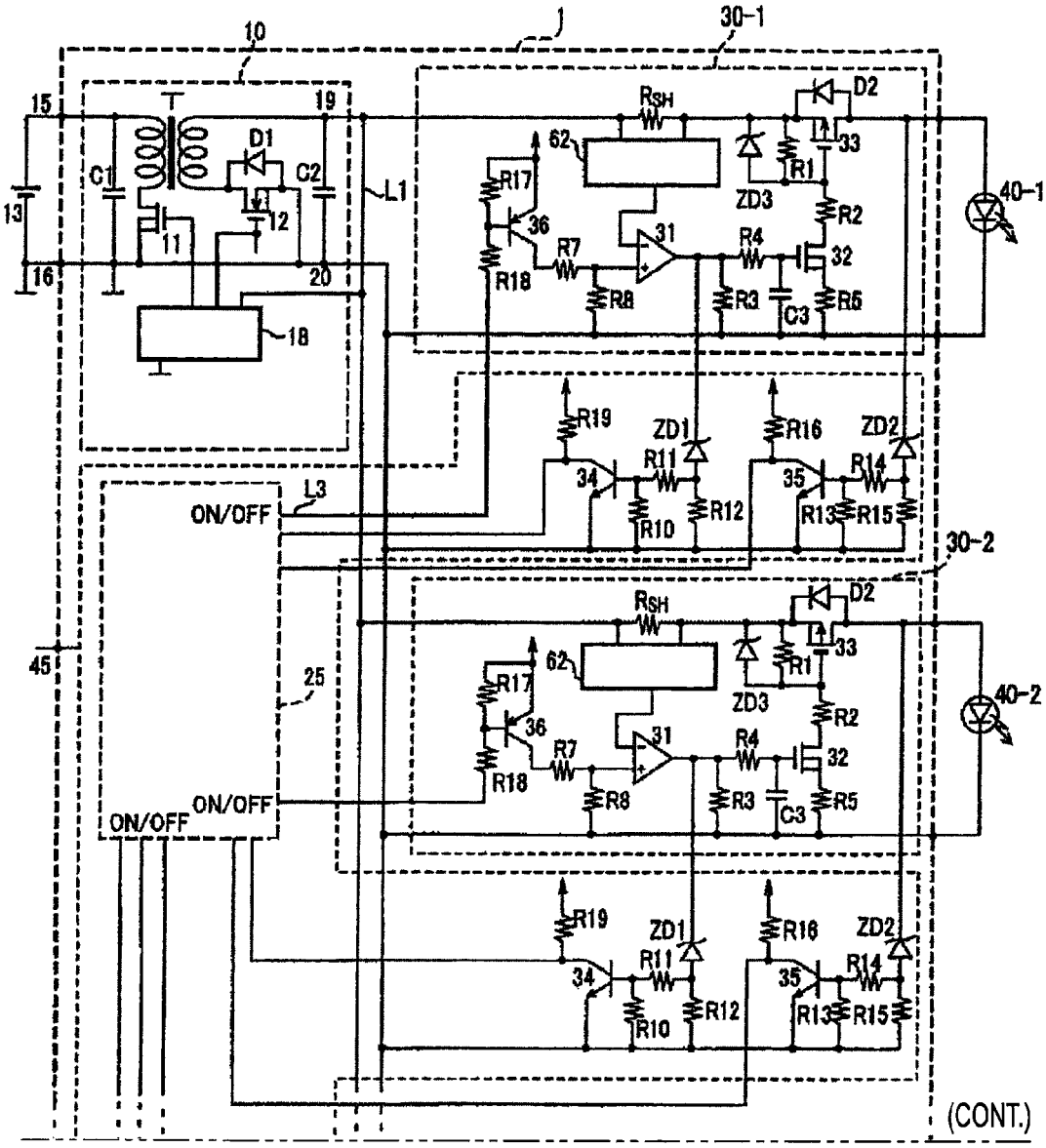
FIG. 1 shows an arrangement of a lighting controller for a vehicle lamp according to a first embodiment of the present invention.

As illustrated in the example of FIG. 1, the lighting controller for a vehicle lamp 1 has a single switching regulator 10, LEDs 40-1 to 40-N as a semiconductor light source, current driving portions 30-1 to 30-N and a control portion 50 as control means.

The switching regulator 10 supplies an LED driving current to the LEDs 40-1 to 40-N as a flyback-type switching regulator.

The switching regulator 10 includes capacitors C1, C2, a transformer T, a parasitic diode D1, NMOS transistors 11, 12 and a switching regulator control circuit 18. Both ends of the capacitor C1 are connected respectively to power supply input terminals 15, 16, while both ends of the capacitor C2 are connected respectively to output terminals 19, 20. The power supply input terminal 15 is connected to the positive (+) terminal of a vehicle-mounted battery 13, whereas the power supply input terminal 16 is connected to the negative (−) terminal of the vehicle-mounted battery 13. The output terminal 19 is connected to the anode side of each of the LEDs 40-1 to 40-N. The output terminal 20 is connected to the cathode side of each of the LEDs 40-1 to 40-N.

In the switching regulator 10, a switching signal output from the switching regulator control circuit 18, for example, a switching signal of frequency from several tens of kHz to several hundreds of kHz is used. The NMOS transistor 11 is thus subjected to ON/OFF operation. In order that a direct current voltage provided between the power supply input terminals 15 and 16 is used as light emitting energy for each of LEDs 40-1 to 40-N, the direct current voltage is converted to an alternate current voltage. The direct current voltage is converted to the alternate current voltage on the primary side of the transformer T, and the alternate current voltage is rectified on the secondary side of the transformer T.

A diode is known as an element for rectifying current. In the first embodiment, since a switching regulator needs a greater output current when used as a rectifying element, a MOS transistor is preferable to a diode in terms of less damage of the element. Therefore, the NMOS transistor 12 preferably is used as a rectifying element to perform synchronous rectification control. Since the NMOS transistor has lower ON resistance than a PMOS (Positive Channel Metal Oxide Semiconductor) transistor, it is possible to decrease the loss of current and downsize a circuit, if driven on a GND (ground) basis.

A capacitor is known as an element for smoothing the rectified current. An alternate current voltage is rectified by using the NMOS transistor 12 and the parasitic diode D1 provided on the secondary side as a rectifying element, and the rectified current is smoothed by the capacitor C2. The smoothed direct current is supplied to each of LEDs 40-1 to 40-N.

Each of the current driving portions 30-1 to 30-N has a NMOS transistor 32 and a PMOS transistor 33 which act, respectively, as a comparison amplifier 31 and a switch portion, thereby supplying an LED driving current to the LED 40-1 to 40-N. In addition, in place of the NMOS transistor 32, an NPN bipolar transistor can be provided.

A shunt resistor $R_{SH}$ acting as a current detection portion is connected to the anode side of each of the LEDs 40-1 to 40-N. A differential amplifier 62 is connected in parallel to the shunt resistor $R_{SH}$. The LED driving current detected by the shunt resistor $R_{SH}$ is applied as a detection voltage to the negative input terminal of the comparison amplifier 31 via the differential amplifier 62.

The positive input terminal of the comparison amplifier 31 is connected to a collector of the PNP transistor 36 via a resistor R7 and also is connected to the power supply output terminal 20 via a resistor R8. The base of the PNP transistor 36 is connected to an ON/OFF signal output terminal of the control circuit 25 via a resistor R18.

A gate of the NMOS transistor 32 and a Zener diode ZD1 acting as a first voltage drop detection portion (which serves as a control portion 50, described in greater detail below) are connected to a comparison output terminal of the comparison amplifier 31. The NMOS transistor 32 is connected via a resistor R2 to the PMOS transistor 33.

The PMOS transistor 33 and a Zener diode ZD2 acting as a second voltage drop detection portion (which serves as a control portion 50, described in greater detail below) are connected to the anode side of each of the LEDs 40-1 to 40-N.

The control portion 50 includes a control circuit 25 acting as a current driving control portion and an abnormal state detection portion provided on each of current driving portions 30-1 to 30-N. The control circuit 25 is arranged so as to have at least one of a CPU (Central Processing Unit), a RAM (Random Access Memory) acting as a storage portion and a ROM (Read Only Memory).

The abnormal state detection portion includes a Zener diode ZD1 and an NPN transistor 34 as well as a Zener diode ZD2 and an NPN transistor 35. Collectors of the NPN transistors 34, 35 are connected to the control circuit 25.

Next, a description is given for the operation of the lighting controller according to the first embodiment.

On lighting up the LED 40-1, the control circuit 25 provides a low level signal to the base of a PNP transistor 36 via a signal wire L3. Since the PNP transistor 36 is turned ON upon receipt of the low level signal, a partial pressure of the resistor of a reference voltage is applied to the positive input terminal of the comparison amplifier 31. Therefore, an analog control signal, which turns ON the NMOS transistor, is sent from the comparison amplifier 31 to the gate of the NMOS transistor 32. Upon receipt of the control signal, the NMOS transistor 32 is ON, and the PMOS transistor 33 also is ON. Thus, an LED driving current is supplied to the LED 40-1.

Upon lighting the LED 40-1, the control circuit 25 provides a high level signal to the base of the PNP transistor 36 via the signal wire L3. Since the PNP transistor 36 is turned OFF upon receipt of the high level signal, a control signal for controlling the NMOS transistor so as to turn it OFF is sent from the comparison amplifier 31 to the gate of the NMOS transistor 32. Upon receipt of the control signal, the NMOS transistor 32 is OFF, and the PMOS transistor 33 also is OFF. Thus, an LED driving current is supplied to the LED 40-1.

In this instance, when the LEDs 40-1 to 40-N are normal, current will not flow through the Zener diode ZD1, but the current will flow through the Zener diode ZD2. Therefore, the NPN transistor 34 is OFF, and a high level signal is provided to the control circuit 25 via a pull-up resistor R19.

Next, as an example of a first abnormal state, where only the LED 40-1 is open and the other LEDs 40-2 to 40-N are normal, current will not flow through the cathode side of the LED 40-1. Therefore, output of the comparison amplifier 31 increases, current will flow through the Zener diode ZD1, and the NPN transistor 34 is turned ON, by which a low level signal is sent to the control circuit 25. Thus, an abnormal state resulting from the opening of the LED 40-1 is detected.

Next, as an example of a second abnormal state, where a short circuit occurs between the anode and cathode of the LED 40-1, the voltage on the anode side decreases, by which no current will flow through the Zener diode ZD2. The NPN transistor 35 is turned OFF, sending a high level signal to the control circuit 25. Thus, an abnormal state resulting from a short circuit between the anode and cathode of the LED 40-1 is detected.

Next, as an example of a third abnormal state, where the anode side of the LED 40-1 undergoes grounding, the voltage decreases on the anode side. Thus, no current will flow through the Zener diode ZD2, and the NPN transistor 35 is turned OFF, sending a high level signal to the control circuit 25. Thus, an abnormal state resulting from the fact that the anode side of the LED 40-1 becomes grounded is detected.

As will be described below, control of the current driving portion on detection of the first abnormal state is different from the control of the current driving portion on detection of the second or the third abnormal state.

Next, control of the current driving portion on detection of the first abnormal state is described.

Time from the receipt of a low level signal (hereinafter, referred to as a first abnormal signal) from the NPN transistor 34 upon detection of the first abnormal state until the halted operation of the current driving portion is stored in advance as information on a first time at a storage portion (e.g., RAM, ROM or the like) provided inside the control circuit 25.

After the elapse of the first time read from the storage portion upon receipt of the first abnormal signal, the control circuit 25 controls an output of the comparison amplifier 31 so that the NMOS transistor 32 and the PMOS transistor 33 are turned OFF.

Specifically, the control circuit 25 sends a high level signal after the elapse of the first time upon receipt of the first abnormal signal. The high level signal from the control circuit 25 is provided via the signal wire L3 to the base of the PNP transistor 36. As the PNP transistor 36 is turned OFF upon receipt of the high level signal, no voltage is applied to the positive input terminal of the comparison amplifier 31. On the other hand, a constant voltage is applied to the negative input terminal of the comparison amplifier 31 from the differential amplifier 62. Therefore, a control signal (low level signal) which controls the NMOS transistor so as to turn OFF is sent from the comparison amplifier 31 to the gate of the NMOS transistor 32. The NMOS transistor 32 is turned OFF upon receipt of the control signal and the PMOS transistor 33 also is turned OFF. Thus, the supply of LED driving current to the LED 40-1 is halted.

Next, a description is given for control of the current driving portion on detection of the second or the third abnormal states.

Here, when the second abnormal state or the third abnormal state is detected, time from the receipt of a high level signal (hereinafter, referred to as a second abnormal signal) from the NPN transistor 35 to the halted operation of the current driving portion is stored in advance as information on a second time at the storage portion provided inside the control circuit 25.

After the elapse of the second time read from the storage portion upon receipt of the second abnormal signal, the control circuit 25 controls an output of the comparison amplifier 31 so that the NMOS transistor 32 and the PMOS transistor 33 are turned OFF.

Specifically, after the elapse of the second time upon receipt of the second abnormal signal, the control circuit 25 sends a high level signal. Subsequent operations are the same as those that occur upon detection of the first abnormal state.

In this instance, the second time is set to be shorter than the first time. This is because, as described above, it is preferable that, in the first abnormal state, the current driving portion of driving an abnormal LED is controlled so as to make detecting the abnormality less sensitive. It is also preferable that, in the second and the third abnormal states, the current driving portion of driving the abnormal LED is controlled so as to halt the operation thereof substantially instantly.

Where the first abnormal state occurs at the same time as the second and the third abnormal states, priority is given to the current driving control in the second abnormal state (control of halting the operation for a short time). Where priority is given to the current driving control in the first abnormal state (control of halting the operation for a long time), there is a higher probability that an LED may fail.

Therefore, according to the first embodiment, it is possible to determine an abnormality in an appropriate time depending on the type of abnormality of an LED. Further, since the duration time of an abnormal state is counted not by using a CR circuit but by using control means, the lighting controller has a simple design.

Figure 2:
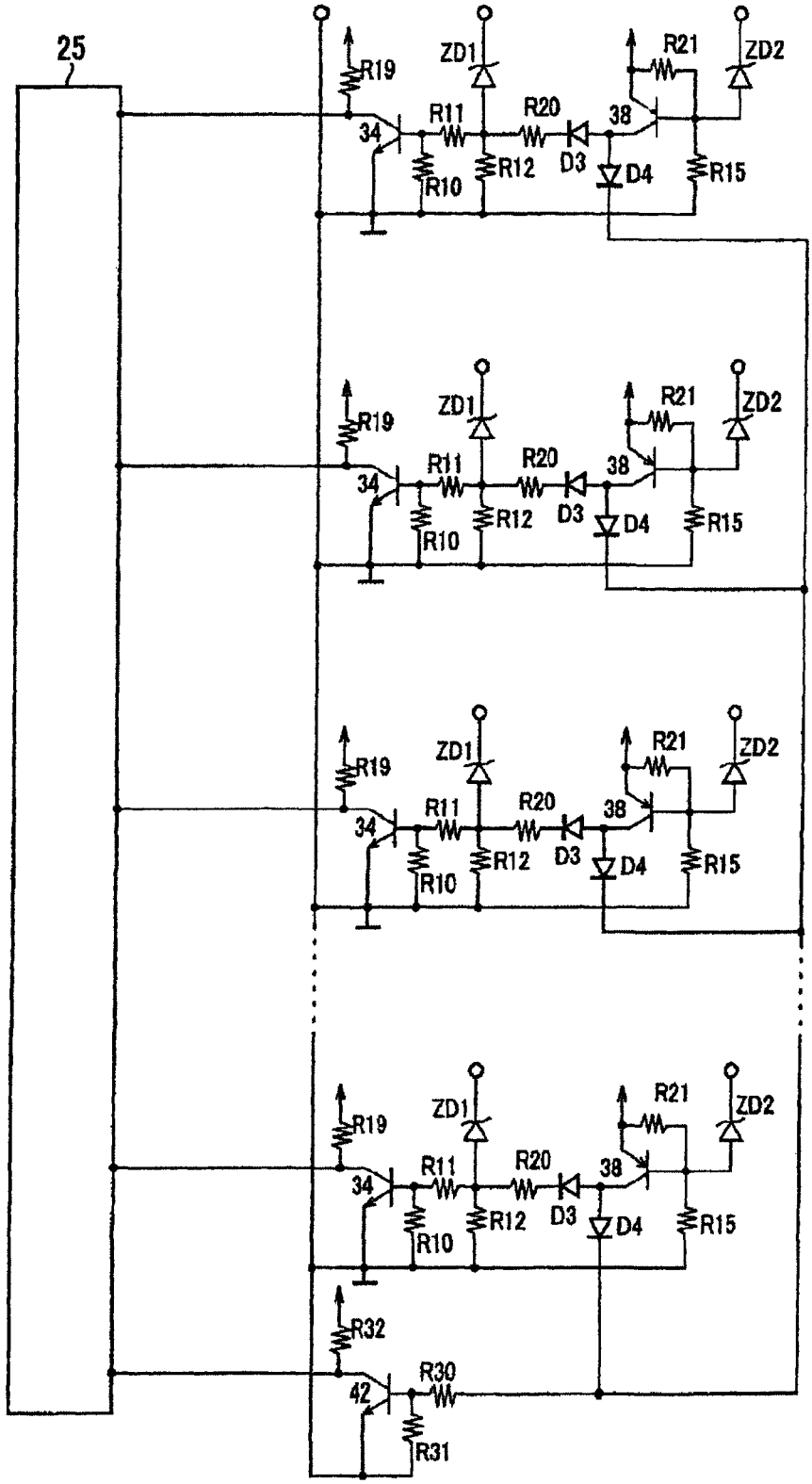
FIG. 2 shows an arrangement of a lighting controller for a vehicle lamp according to the second embodiment of the present invention.

Next, a description is given for the lighting controller for a vehicle lamp according to a second embodiment of the present invention. FIG. 2 shows an arrangement of the lighting controller for a vehicle lamp in the second embodiment of the present invention. Current driving portions 30-1 to 30-N in FIG. 1 are provided on the cathode sides of the Zener diode ZD1 and the Zener diode ZD2 in FIG. 2.

The second embodiment is different from the first embodiment in terms of circuit arrangement on the anode side of the Zener diode ZD2 and connection to the control circuit 25. Therefore, in the second embodiment, only a brief description of the same parts as those of the previously-described first embodiment will be given.

The abnormal state detection portion of the second embodiment includes the Zener diode ZD1 and the NPN transistor 34 for detecting the above-described first abnormal state, the Zener diode ZD2 and the PNP transistor 38 for detecting the above-described second and the third abnormal states, and the NPN transistor 42 for detecting the above-described second and the above-described third abnormal states. The collector of the NPN transistor 34 is connected to the control circuit 25. The base of the PNP transistor 38 is connected to the anode of the Zener diode ZD2, and the collector of the PNP transistor 38 is connected to the anodes of diodes D3 and diodes D4.

Cathodes of the individual diodes D4 are all connected to the base of the NPN transistor 42. The collector of the NPN transistor 42 is connected to the control circuit 25. An emitter of the NPN transistor 42 is connected to an emitter of each of the NPN transistors 34 and an output terminal 20 of the power supply.

Where the first abnormal state is detected, as in the previously-described first embodiment, after the elapse of the first time upon receipt of the first abnormal signal from the NPN transistor 34, the control circuit 25 controls a comparison output of the comparison amplifier 31 so that the NMOS transistor 32 and the PMOS transistor 33 are turnedOFF.

Where the second or the third abnormal state is detected, no current will flow through the Zener diode ZD2, the PNP transistor 38 is turned ON, and the NPN transistors 34 and 42 also are turned ON. The NPN transistors 34 and 42 send the second abnormal signal to the control circuit 25. After the elapse of the second time upon receipt of the second abnormal signal, the control circuit 25 controls a comparison output of the comparison amplifier 31 so that the NMOS transistor 32 and the PMOS transistor 33 are turned OFF.

Specifically, after the elapse of the second time upon receipt of the second abnormal signal, the control circuit 25 sends a high level signal to the PNP transistor 36. Subsequent operations are the same as those on detection of the first abnormal state.

According to the foregoing arrangement, even where at least any one of the LEDs 40-1 to 40-N is in the second or the third abnormal state, the second abnormal signal is sent by the NPN transistor 42 to the control circuit 25 without fail. The control circuit 25 sends a high level signal to the PNP transistor 36 after the elapse of the second time upon the receipt of the second abnormal signal.

The number of abnormality detection terminals in the control circuit 25 is a number (N+1) obtained by adding one to the number of current driving portions 30-1 to 30-N. Therefore, an abnormality can be determined in an appropriate time depending on the type of abnormality of an LED by using a circuit arranged so as to reduce the number of abnormality detection terminals to the minimum necessary. Specifically, it is possible to provide the same functions as those of the first embodiment and also reduce the number of input channels of the control circuit.

Where the first abnormal state occurs at the same time as the second and the third abnormal states, priority is given to the current driving control in the second abnormal state (control of halting the operation for a short time) as in the previously-described first embodiment.

The embodiments so far described are only examples of preferred embodiments of the present invention. The present invention can be implemented using various modifications within the scope of the claims.

What is claimed is:

1. A lighting controller for a vehicle lamp, the lighting controller comprising:

a switching regulator for supplying a driving current to a first to an N-th semiconductor light source, wherein N is an integer number equal to or greater than one;

a first to an N-th current driving means which include a first to an N-th current detection portion respectively connected in series to each of the semiconductor light sources to detect the driving current, a first to an N-th switch portion respectively connected to the positive electrode side of each of the semiconductor light sources, and a first to an N-th comparison portion for comparing a value of the driving current detected by each of the current detection portions with a predetermined threshold value, for sending a comparison output according to an obtained comparison result, and for controlling ON/OFF operation of each of the switch portions according to respective comparison outputs; and control means having two or more abnormality detection portions for detecting an abnormality generated in the current driving means and for sending an abnormality detection result;

wherein the control means is arranged to control each of the switch portions so as to turn them OFF after elapse of a predetermined time upon receipt of the abnormality detection result, and wherein the predetermined time varies depending on a type of abnormal state indicated by the abnormality detection result sent by the two or more abnormality detection portions, and wherein the abnormality detection result comprises an indication of at least one of a first abnormal state in which one of the semiconductor light sources is open, a second abnormal state in which one of the semiconductor light sources is shorted, and a third abnormal state in which an anode of one of the semiconductor light sources is grounded.

2. The lighting controller for a vehicle lamp as set forth in claim 1, wherein the control means comprises:

a first to an N-th first abnormality detection portion which detect an output side voltage of the comparison portion, compare the detected output side voltage with a predetermined reference value to detect an abnormality, and send respectively a first to an N-th first abnormality detection result; and a first to an N-th second abnormality detection portion which detect a positive electrode side voltage of the semiconductor light source, compare the detected positive electrode side voltage with a predetermined reference value to detect an abnormality and send respectively a first to an N-th second abnormality detection result; and wherein the control means is arranged so that after elapse of the first time respectively upon receipt of the first to the N-th first abnormality detection result or after elapse of the second time respectively upon receipt of the first to the N-th second abnormality detection result, a comparison output at the first to the N-th comparison portion is controlled so that each of the switch portions is turned OFF.

3. The lighting controller for a vehicle lamp as set forth in claim 2, wherein the control means has a current driving control portion including a storage portion which stores in advance the first time and the second time, and the current driving control portion is arranged so that, after elapse of the first time and after the elapse of the second time read from the storage portion respectively upon receipt of the first abnormality detection result and the second abnormality detection result, the current driving control portion sends a control signal to the comparison portion so that each of the switch portions is turned OFF.

4. The lighting controller for a vehicle lamp as set forth in claim 2, wherein when at least one abnormality detection portion of the first abnormality detection portions and the second abnormality detection portions detects an abnormality, the abnormality detection result is sent by a single first signal wire, and when at least one abnormality detection portion of the first to the N-th second abnormality detection portion detects an abnormality, the second abnormality detection result is sent by a single second signal wire.

5. The lighting controller for a vehicle lamp as set forth in claim 3, wherein when at least one abnormality detection portion of the first abnormality detection portions and the second abnormality detection portions detects an abnormality, the abnormality detection result is sent by a single first signal wire, and when at least one abnormality detection portion of the first to the N-th second abnormality detection portion detects an abnormality, the second abnormality detection result is sent by a single second signal wire.

* * * * *